US006502927B2

(12) United States Patent
Nozawa

(10) Patent No.: US 6,502,927 B2
(45) Date of Patent: Jan. 7, 2003

(54) INK JET RECORDING HEAD HAVING TWO OR MORE PILLARS FOR EACH NOZZLE

(75) Inventor: Minoru Nozawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/025,865

(22) Filed: Dec. 26, 2001

(65) Prior Publication Data

US 2002/0085077 A1 Jul. 4, 2002

(30) Foreign Application Priority Data

Dec. 28, 2000 (JP) ..... 2000-400311

(51) Int. Cl.[7] ..... B41J 2/05; B41J 2/175; B41J 2/17

(52) U.S. Cl. ..... 347/65; 347/93; 347/94

(58) Field of Search ..... 347/63, 65, 93, 347/94, 56, 61, 67

(56) References Cited

U.S. PATENT DOCUMENTS 5,463,413 A * 10/1995 Ho et al. ..... 347/65
5,519,423 A * 5/1996 Moritz, III et al. ..... 347/65
5,734,399 A * 3/1998 Weber et al. ..... 347/65
6,007,188 A * 12/1999 MacLeod et al. ..... 347/65

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

An ink jet recording head includes a plurality of nozzles constituting a row of nozzles, a plurality of discharge ports for discharging ink, corresponding to the plurality of nozzles, the discharge ports communicating with the nozzles, respectively, an energy generating device for generating energy for discharging the ink from the discharge ports, a common liquid compartment in communication with the plurality of nozzles constituting the row of nozzles, a first filter provided at an end of at least one nozzle of the row of nozzles, the end being adjacent to the common liquid compartment, and a second filter that is provided at an end of a nozzle other than the nozzle provided with the first filter and that has a flow resistance lower than that of the first filter, the end being adjacent to the common liquid compartment.

11 Claims, 6 Drawing Sheets

INK JET RECORDING HEAD HAVING TWO OR MORE PILLARS FOR EACH NOZZLE

BACKGROUND OF THE INVENTION

1. Field of the Invention

The present invention relates to an ink jet recording head designed to perform recording by discharging a recording liquid (hereinafter referred to as "ink") in the form of flying droplets from an ink discharge port and by directing the droplets onto a material to be recorded on, to which the droplets adhere.

2. Description of the Related Art

An ink jet recording apparatus uses a "non-impact" recording method, and is advantageous in that it features high-speed recording and compatibility with a variety of types of recording media and is very quiet while recording. Because of these advantages, ink jet recording apparatuses are in extensive use as the recording mechanisms for printers, word processors, facsimiles, copying machines, etc.

A typical ink jet recording method employs electrothermal converting elements to cause minute droplets to be discharged from minute discharge ports so as to implement recording on a sheet of recording paper. The ink jet recording apparatus employing this method is generally constituted by an ink jet recording head for forming droplets and a system for supplying the ink to the head. The ink jet recording head using the electrothermal converting elements applies electrical pulses providing recording signals to the electrothermal converting elements installed in a pressurizing chamber so as to supply thermal energy to the recording liquid therein. This causes the recording liquid to change its phase, and bubble pressure is produced when the recording liquid bubbles or boils. The bubble pressure is utilized to discharge the recording liquid.

In recent years, there has been a demand for such an ink jet recording head to achieve a higher recording speed (a driving frequency of several dozen kHz). To meet the demand, a "block-based drive" method has been known to be in use, in which the rows of nozzles are divided into blocks, and driving pulses for the same block are simultaneously sent to the electrothermal converting elements thereof.

However, if adjoining nozzles belong to different blocks, back waves generated when a first block bubbles may cause the adjoining nozzles to develop meniscus vibration. If driving pulses are sent to the electrothermal converting elements in the nozzles during meniscus vibration, the discharge will be adversely affected, with consequent unstable discharge direction or increased discharge mist. To solve such a problem, the interval between the blocks may be increased, and the driving may be started after the meniscus vibration ceases. This, however, has caused a drop in driving frequency.

Furthermore, when such block-based driving is performed, if different nozzle lengths are used to compensate for the differences in discharge timing, the distances from the electrothermal converting elements to the ink supply ports change and the flow resistances in the nozzles change accordingly, possibly causing the post-discharge ink refilling time to vary.

Meanwhile, a pillar-and-gap filter in a vicinity of a nozzle (hereinafter referred to simply as "a nozzle filter") has been disclosed in Japanese Patent Laid-Open No. 05-124206, Japanese Patent Laid-Open No. 10-86377, etc. The pillar-and-gap filter is intended to prevent failure attributable to dust being mixed into a recording head during its manufacturing process or a recording head in use. However, achieving a higher recording speed requires improved efficiency of ink refilling after discharge, so that the flow resistance in a nozzle filter is required to be minimized. On the other hand, to block dust, the opening of the nozzle filter must be made smaller to minimize the amount of dust entering the nozzle. The conventional nozzle filters have not actually been very successful in meeting the conflicting requirements.

SUMMARY OF THE INVENTION

Accordingly, it is an object of the present invention to provide an ink jet recording head that solves the problems described above, and permits high-speed recording despite its simple construction.

To this end, according to the present invention, there is provided an ink jet recording head including a plurality of nozzles constituting a row of nozzles, a plurality of discharge ports for discharging ink, corresponding to the plurality of nozzles, the discharge ports communicating with the nozzles, respectively, energy generating devices for generating energy for discharging the ink from the discharge ports, and a common liquid compartment in communication with the plurality of nozzles constituting the row of nozzles, and further including a first filter provided at an end of at least one nozzle of the row of nozzles, the end being adjacent to the common liquid compartment, and a second filter that is provided at an end of a nozzle other than the nozzle provided with the first filter and that has a flow resistance lower than that of the first filter, this end also being adjacent to the common liquid compartment. To trap dust even more reliably, it is further preferred that at least one of two adjoining nozzles of a nozzle provided with the second filter is equipped with the first filter.

This arrangement makes it possible to satisfy two conflicting requirements, namely, the requirement for improved post-discharge ink refilling efficiency and the requirement for effectively trapping dust, which has not been achieved by conventional nozzle filters. More specifically, the delay in ink refilling can be improved by decreasing the flow resistance of the filter for a nozzle that is apt to cause delayed ink refilling because of its greater length. At the same time, however, the longer nozzle is provided with a filter to ensure reliable trapping of dust.

Further objects, features and advantages of the present invention will become apparent from the following description of the preferred embodiments with reference to the attached drawings.

DESCRIPTION OF THE PREFERRED EMBODIMENTS

The present invention will now be described in detail in conjunction with the accompanying drawings.

Figure 5:
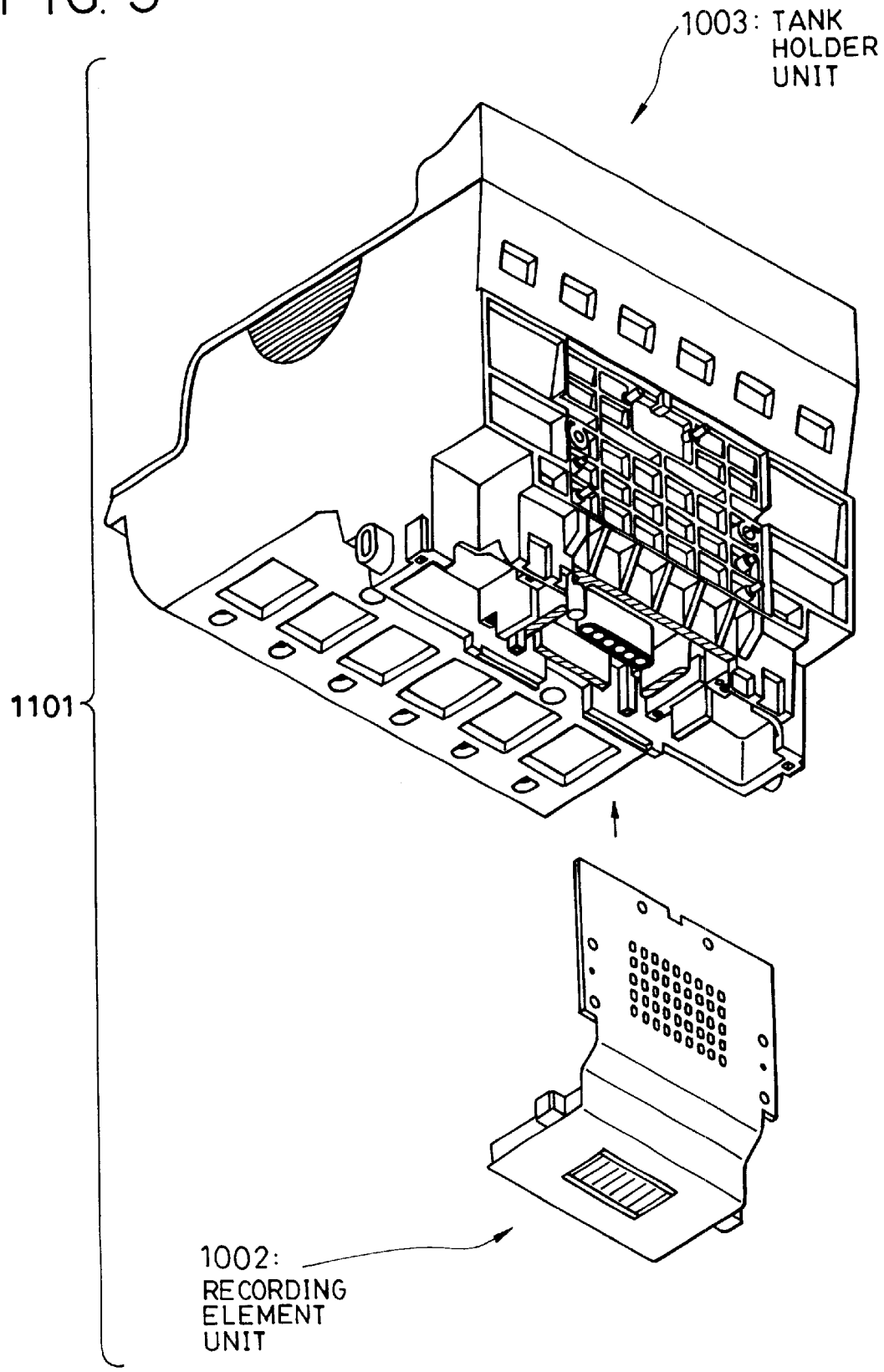
FIG. 5 is an assembly view showing an ink jet recording head in accordance with the present invention.

FIG. 5 is an assembly view showing an ink jet recording head in accordance with the present invention. A recording head 1001 is a bubble jet, side shooter type recording head designed to perform recording by using electrothermal converting elements for generating thermal energy for causing ink to start film boiling in response to electrical signals.

Figure 6:
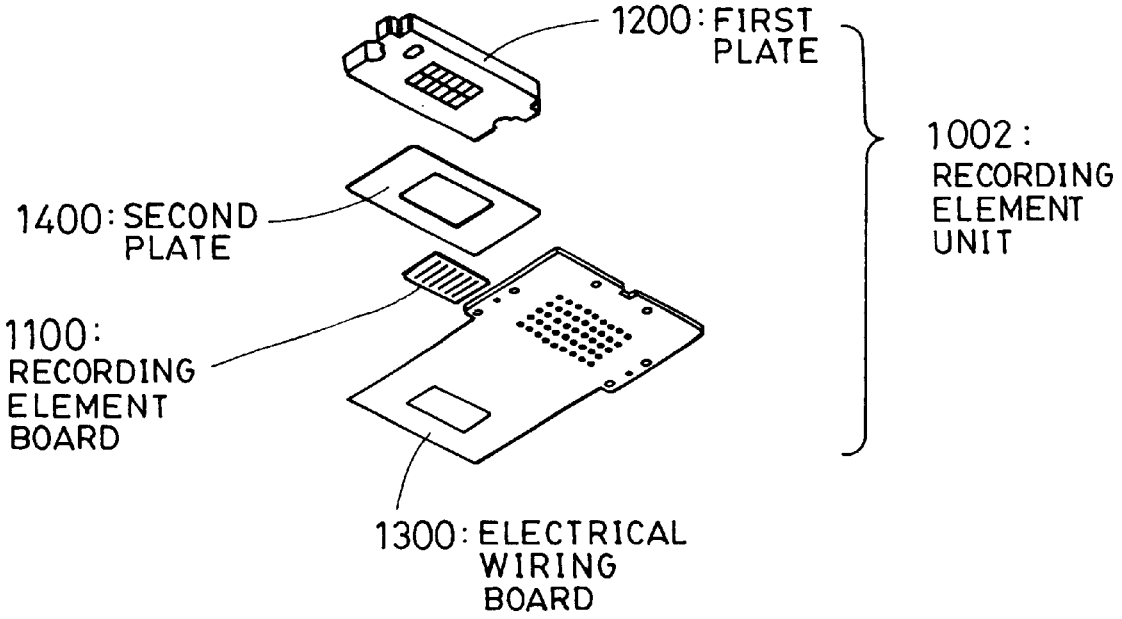
FIG. 6 is an assembly view showing a recording element unit in accordance with the present invention.

The recording head 1001 is constructed by a recording element unit 1002 and a tank holder unit 1003. As shown in the assembly view of FIG. 6, the recording element unit 1002 is constructed of a recording element board 1100, a first plate 1200, an electrical wiring board 1300, and a second plate 1400.

First Embodiment

Figure 1A:
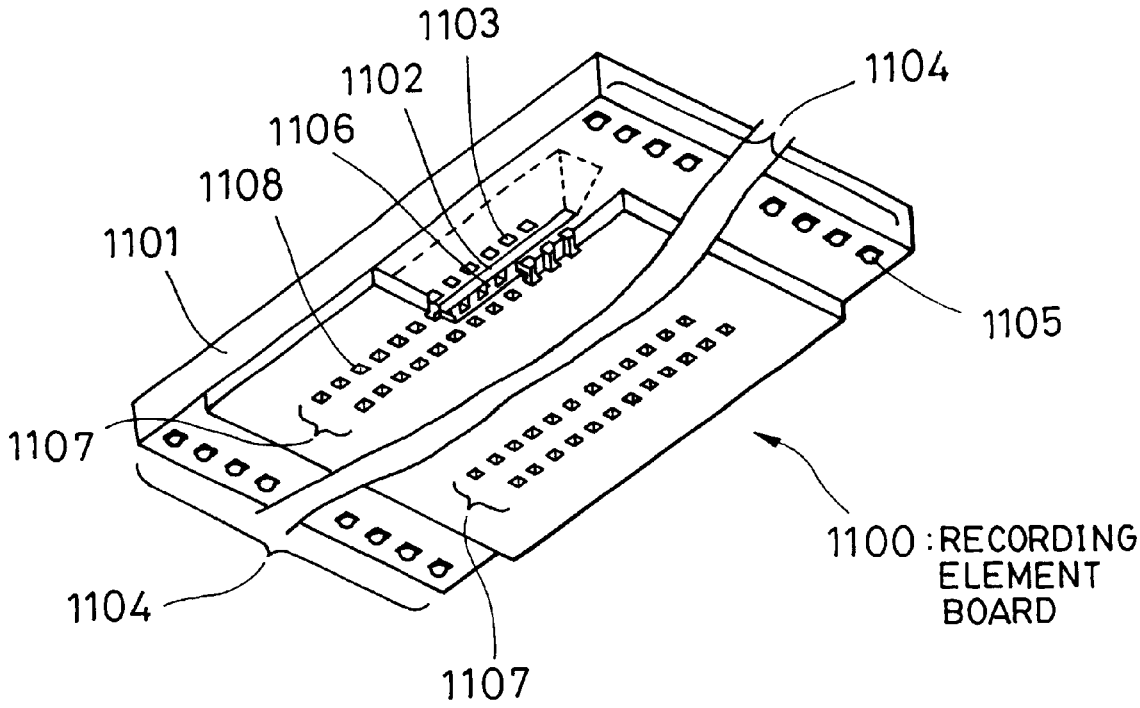
FIG. 1A is a perspective view of a recording element board representing a first embodiment in accordance with the present invention.
Figure 1B:
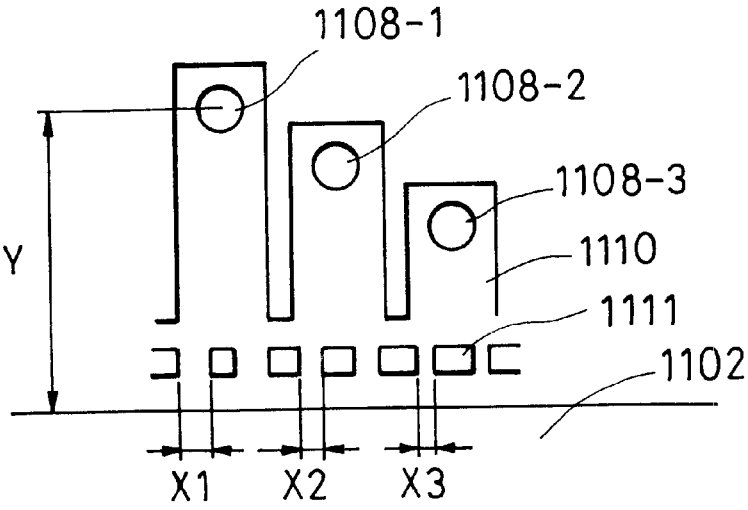
FIG. 1B is a schematic plan view of a nozzle assembly of the recording element board in accordance with the present invention.

FIG. 1A is a perspective view of the recording element board 1100 best representing the characteristics of the present invention, and FIG. 1B is an enlarged plan view of a nozzle assembly. The recording element board 1100 shown in FIG. 1A is constituted by, for example, a Si substrate 1101 that is 0.5 mm to 1 mm thick, and has a thin film formed thereon. Six rows of ink supply ports 1102 formed of long groove-like through openings are provided as the ink passages for six colors. Provided on both sides of each of the ink supply ports 1102 are electrothermal converting elements (hereinafter referred to as "heaters") 1103, one row on each side, in a zigzag pattern. The heaters 1103 and electrical wires, including aluminum wires, for supplying electric power to the heaters 1103 are formed by a film forming technique. Electrode sections 1104 for supplying electric power to the electrical wires are provided with bumps 1105 formed of gold or the like. The ink supply ports 1102 are formed by anisotropic etching by making use of the crystal orientation of the Si substrate 1101. Ink passage walls 1106 for forming the ink passages associated with the heaters 1103, and discharge ports 1108 are formed on the Si substrate 1101 by photolithography so as to form six rows of discharge ports for the inks of six colors. The heaters 1103 are provided such that they oppose the discharge ports 1108. The inks supplied from the ink supply ports 1102 are bubbled by the heaters 1103 and discharged.

FIG. 1B is a schematic diagram showing nozzles, discharge ports, and nozzle filters in accordance with the present invention. Discharge ports 1108-1, 1108-2, and 1108-3 have different distances Y from the ink supply ports 1102 to the discharge ports 1108 in order to compensate for the differences in discharge timings. For instance, if a 256-nozzle recording head of a 600 dpi density, including two rows of nozzles in a zigzag pattern, is to be driven at 1200 dpi and 15 kHz, then sixteen-division driving is performed to restrain a voltage drop that would be caused by simultaneous driving. (If the voltage drop is smaller, then the division number may be smaller.) In this example, a discharge timing difference of 1200 dpix15/16 takes place between a first block and a sixteenth block. To compensate for the timing difference, the positions of the discharge ports are shifted on a driving block basis. In the nozzles thus constructed, the distances from the heaters 1103 to the ink supply ports 1102 are different and the flow resistances of the nozzles are therefore different, with resultant different times required for ink refilling after discharge. Especially in this case of the recording head of 600 dpi and two-row layout, the nozzle pitch is small (42 $\mu$m), and the differences in flow resistance significantly influence the ink refilling time.

Hence, according to the embodiment, pillars 1111 made of a nozzle forming-material are provided between the nozzles 1110 and the ink supply ports 1102. The pillars and the gaps between them serve as nozzle filters. Gap widths X1, X2, and X3 are set to large values for nozzles having a large distance Y from the ink supply ports 1102 to the discharge ports 1108, while they are set to small values for nozzles having a small distance Y.

With this arrangement, an improved filtering effect can be achieved, as compared with a case where nozzle filters of a single large opening size (gap size) are used. Even in the case of filters having large opening sizes, the gap widths of the filters are set to be smaller than the widths of the nozzles or the widths of the discharge ports, whichever are narrower. The opening widths X2 and X3, which are somewhat small, are set to be small to an extent such that the ink refilling does not take longer in short nozzles than in long nozzles.

This arrangement allows long nozzles and short nozzles to have the same refilling time.

Second Embodiment

Figure 2A:
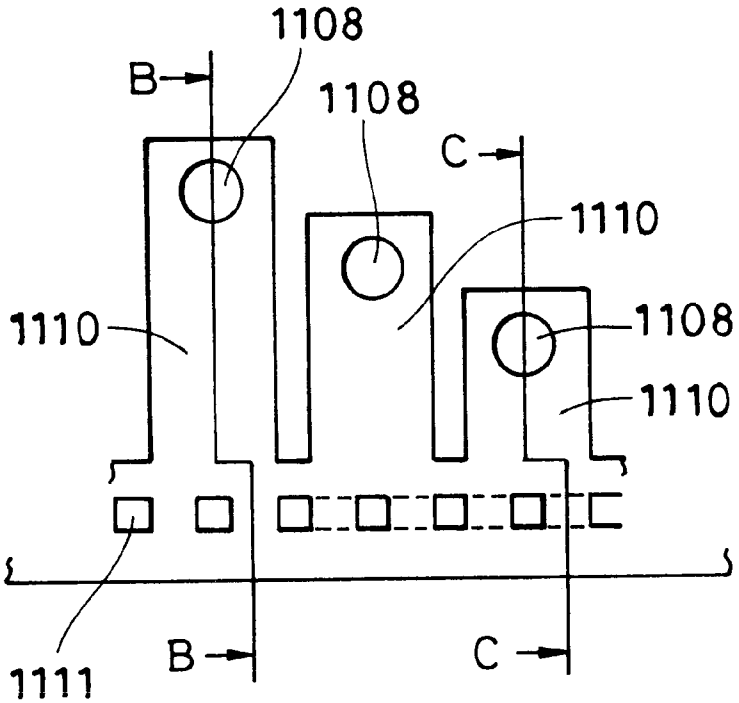
FIG. 2A is a schematic plan view of a nozzle assembly representing a second embodiment in accordance with the present invention.
Figure 2B:
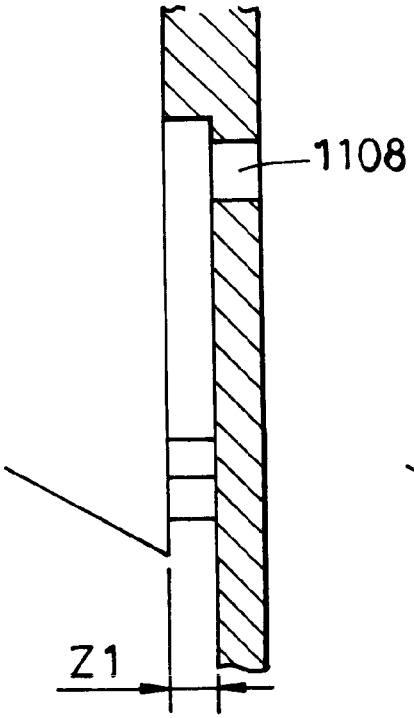
FIG. 2B is a sectional view taken at the line B—B of the nozzle assembly shown in FIG. 2A.
Figure 2C:
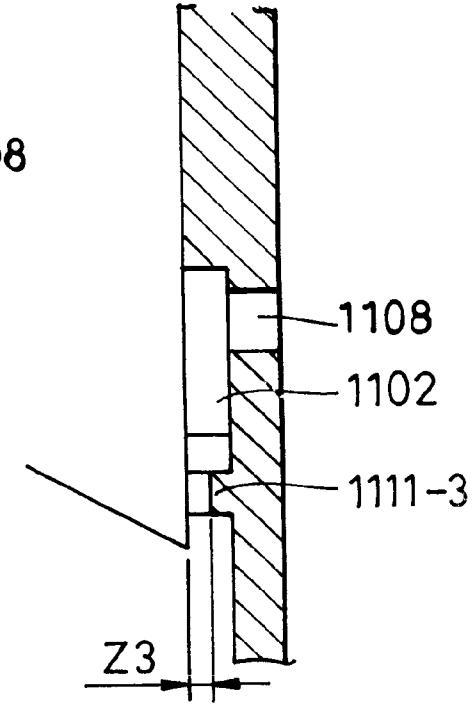
FIG. 2C is a sectional view taken at the line C—C of the nozzle assembly shown in FIG. 2A.

FIG. 2A is a schematic plan view showing a second embodiment. FIGS. 2B and 2C are sectional views taken at the lines B—B and C—C, respectively.

Pillars 1111 made of a nozzle forming material are provided between nozzles 1110 and ink supply ports 1102. The pillars and the gaps between them serve as nozzle filters. Gap heights Z1 and Z3 are set to large values for nozzles having a large distance Y from the ink supply ports 1102 to the discharge ports 1108, while they are set to small values for nozzles having a small distance Y. With this arrangement, an improved filtering effect can be achieved, as compared with a case where nozzle filters of a single large opening size are used. Even in the case of filters having large opening sizes, the gap heights of the filters are set to be smaller than the heights of the nozzles or the heights of the discharge ports, whichever are shorter. The height Z3 of the pillar 1111-3 having a somewhat small opening height shown in FIG. 2C is set to be small to an extent such that the ink refilling does not take longer in short nozzles than in longer nozzles.

Third Embodiment

Figure 3:
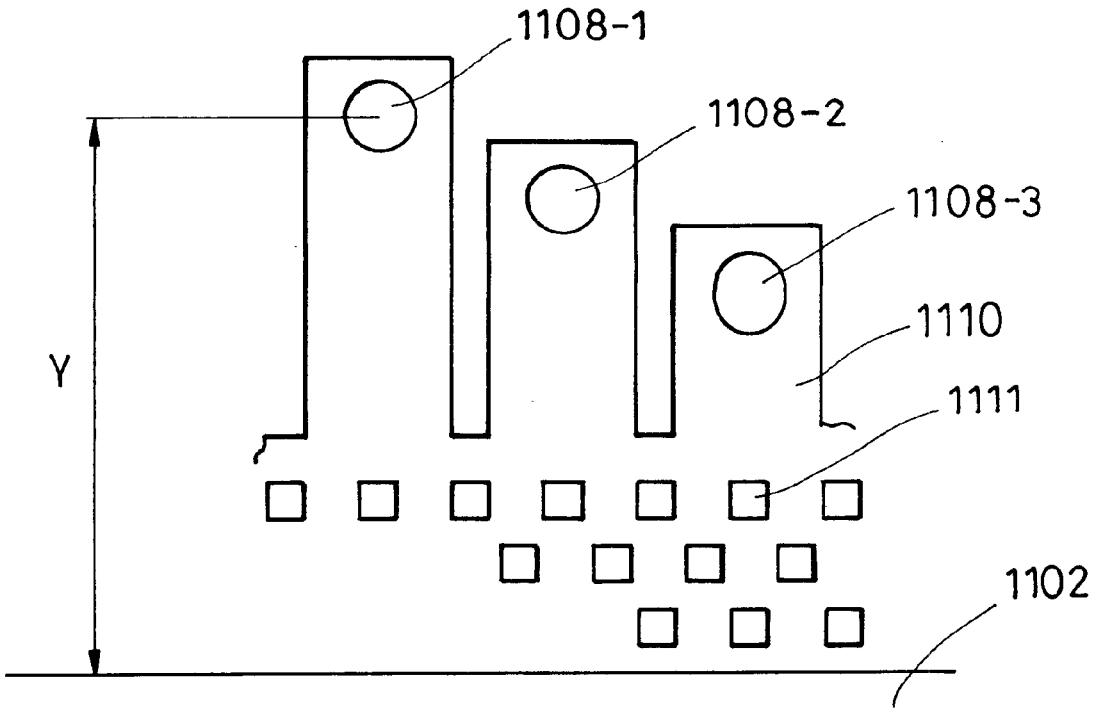
FIG. 3 is a schematic plan view of a nozzle assembly representing a third embodiment in accordance with the present invention.

Referring to FIG. 3, pillars 1111 made of a nozzle forming material are provided between nozzles 1110 and ink supply ports 1102. The pillars and the gaps between them serve as nozzle filters. In this embodiment, a single row of the pillars 1111 is provided for a longer nozzle, while a plurality of rows of the pillars 1111 is provided for shorter nozzles. With this arrangement, an improved filtering effect can be achieved, as compared with a case where nozzle filters of a single large opening size are used. Even in the case of filters having large opening sizes, the opening sizes of the filters are set to be smaller than the opening sizes of the nozzles or the opening sizes of the discharge ports, whichever are smaller. The number of rows of the pillars 1111 is to be set so that the ink refilling does not take longer in shorter nozzles than in longer nozzles.

Fourth Embodiment

In the first through third embodiments explained above, the nozzle lengths are different in different blocks. The present invention, however, is not limited to the cases where the rows of nozzles have different nozzle lengths. The present invention can be suitably applied also to a case where the rows of nozzles have the same nozzle length, as described below. FIGS. 4A through 4D are schematic diagrams illustrating, in time series, how a liquid is discharged in a recording head representing a fourth embodiment in accordance with the present invention.

Figure 4A:
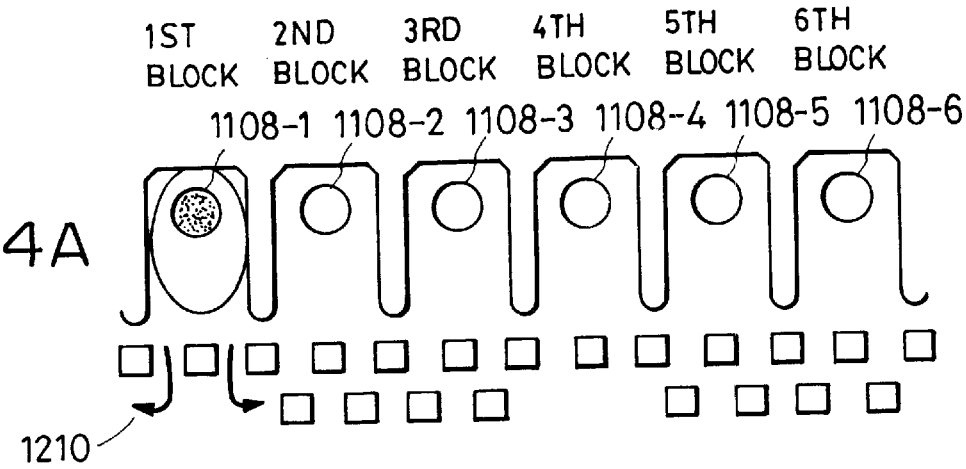
FIGS. 4A through 4D are schematic diagrams showing, in time series, how a liquid is discharged by a recording head representing a fourth embodiment in accordance with the present invention.
Figure 4B:
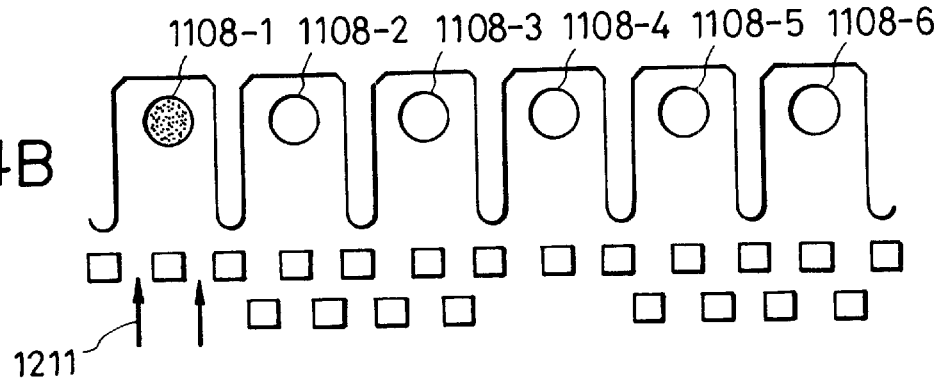

FIG. 4A shows a bubbling state generated when the heaters are driven in an ink jet recording head with aligned nozzles according to this embodiment. The head is constructed by six drive blocks, first through sixth drive blocks, the nozzles 1108-1 through 1108-6 being arranged in the order of the first, the second, . . . , and the sixth (the nozzle after the sixth block belongs to the first block). FIG. 4A shows a state wherein the ink in nozzles 1108-1 of the first block has been bubbled. At this time, the bubbling generates a pressure wave 1210 directed toward the common liquid compartment. In this embodiment, however, the nozzle filters for nozzles 1108-2 and 1108-3 are disposed in two rows so as to make the flow resistance here higher than that of the single row of nozzle filters provided for the nozzles 1108-1. This increased flow resistance restrains the propagation of the pressure wave to adjoining nozzles, which in turn controls meniscus vibration. FIG. 4B illustrates a state wherein the nozzles of the first block are being refilled with ink. The nozzles of 1108-1 have a single row of nozzle filters and hence have lower flow resistance, so that they are refilled with ink by a fast flow indicated by arrows 1211.

Figure 4C:
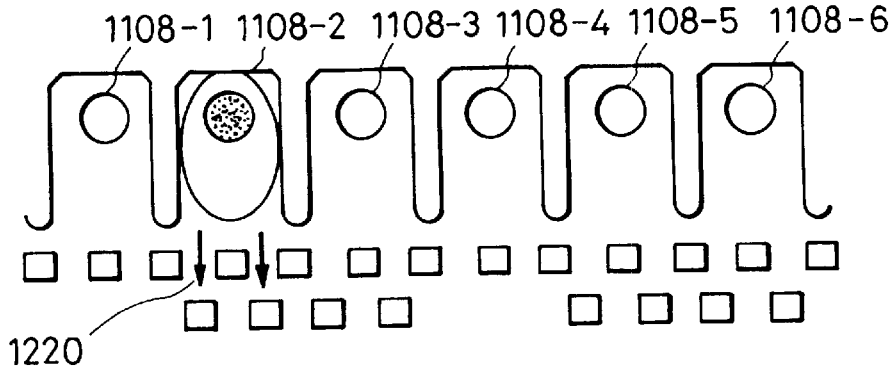
Figure 4D:
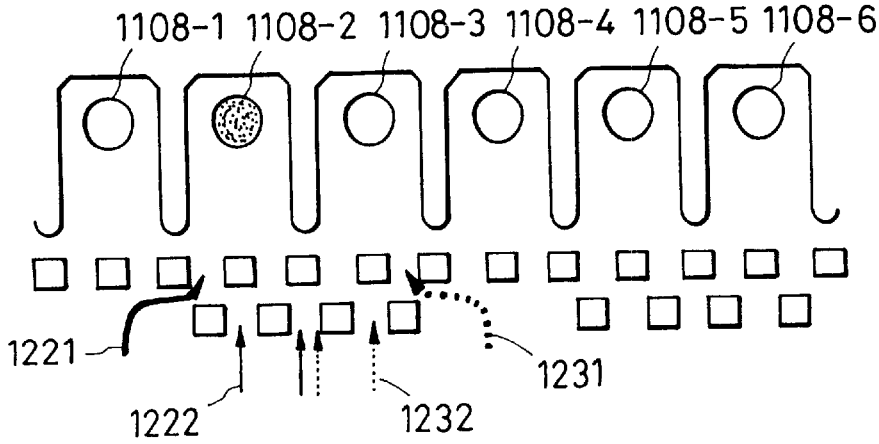

FIG. 4C shows a state wherein the ink in nozzles 1108-2 of the second block has been bubbled. At this time, pressure waves indicated by arrows 1220 are generated; however, the pressure waves are attenuated by the two rows of nozzle filters, exerting less influence on adjoining nozzles. FIG. 4D illustrates a state wherein the nozzles of the second block and the third block are being refilled with ink. The solid line arrows indicate the ink refilling of the nozzles 1108-2 (the second block). A side flow indicated by an arrow 1221 is added to the ink refilling flow indicated by arrows 1222. In other words, the nozzles 1108-1 are provided with a single row of nozzle filters and hence have lower flow resistance, causing the ink flow to these nozzles to merge with the ink flow to adjacent nozzles. Therefore, the ink refilling can be improved over the case where the nozzles are all provided with two rows of nozzle filters. The dotted-line arrows 1232 indicate the ink refilling of the nozzles 1108-3 (the third block). The nozzles 1108-4 are provided with a single row of nozzle filters and hence have lower flow resistance, causing a flow 1231 to merge with the flow 1232. This also leads to improved ink refilling efficiency.

Thus, for the nozzles aligned in a single row, the meniscus vibration can be restrained and deterioration in ink refilling performance can be reduced at the same time by providing the nozzles with a plurality of types of nozzle filters. More specifically, the aforesaid two requirements can be both satisfied by providing nozzle filters having lower flow resistance at intervals of two nozzles (at least one of the nozzles adjacent to a nozzle having lower flow resistance being a nozzle with higher flow resistance).

More preferably, all embodiments described above use the pillar-and-gap nozzle filters to restrain dust from entering into nozzles during a manufacturing process for recording heads. It is also easily possible to provide a plurality of types of filters for each nozzle.

Thus, the present invention makes it possible to substantially meet the two conflicting requirements, namely, the requirement for improved post-discharge ink refilling efficiency and the requirement for improved dust trapping performance. Meeting these two requirements have been unachievable in conventional nozzle filters.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. An ink jet recording head comprising:

a plurality of nozzles constituting a row of nozzles;

a plurality of discharge ports for discharging ink, corresponding to said plurality of nozzles, said discharge ports communicating with said nozzles, respectively;

energy generating means for generating energy for discharging the ink from the discharge ports;

a common liquid compartment in communication with the plurality of nozzles constituting the row of nozzles;

a first filter provided at an end of at least one nozzle of the row of nozzles, the end being adjacent to the common liquid compartment; and a second filter that is provided at an end of a nozzle other than the nozzle provided with the first filter and that has a flow resistance lower than that of the first filter, the end being adjacent to the common liquid compartment, wherein the first and second filters each comprise two or more pillars for each nozzle, and wherein the first and second filters differ in respect of the relative sizes of the pillars and gaps between the pillars.

2. The ink jet recording head according to claim 1, wherein the row of nozzles has a variety of nozzle lengths to compensate for differences in discharge timing, and a nozzle with a smaller length is provided with the first filter, while a nozzle with a larger length is provided with the second filter.

3. The ink jet recording head according to claim 1, wherein one of two nozzles adjacent to a nozzle provided with the second filter is provided with the first filter.

4. An ink jet recording head comprising:

a plurality of nozzles constituting a row of nozzles;

a plurality of discharge ports for discharging ink, corresponding to said plurality of nozzles, said discharge ports communicating with said nozzles, respectively;

energy generating means for generating energy for discharging the ink from the discharge ports;

a common liquid compartment in communication with the plurality of nozzles constituting the row of nozzles;

a first filter provided at an end of at least one nozzle of the row of nozzles, the end being adjacent to the common liquid compartment; and a second filter that is provided at an end of a nozzle other than the nozzle provided with the first filter and that has a flow resistance lower than that of the first filter, the end being adjacent to the common liquid compartment, wherein the first and second filters each comprise two or more pillars for each nozzle, and wherein the first and second filters differ in respect of the number of pillars and gaps between the pillars.

5. The ink jet recording head according to claim 4, wherein one of two nozzles adjacent to a nozzle provided with the second filter is provided with the first filter.

6. The ink jet recording head according to claim 4, wherein the row of nozzles has a plurality of nozzle lengths to compensate for differences in discharge timing, and a nozzle with a smaller length is provided with the first filter, while a nozzle with a larger length is provided with the second filter.

7. An ink jet recording head comprising:

at least one row of nozzles comprising plural sets of a discharge port for discharging ink, a nozzle communicating with said discharge port and energy generating means for generating energy for discharging ink from said discharge port;

a common liquid compartment connected to said plurality of nozzles; and an ink supplying member for supplying ink from an ink tank, wherein said ink jet recording head comprises plural kinds of filters comprising pillars provided in the vicinity of the entrance of the nozzles in the rows of nozzles, wherein the number of said pillars provided for each nozzle is two or more, and wherein said plural kinds of filters have different cross-sectional areas of the openings.

8. The ink jet recording head according to claim 7, wherein the rows of nozzles have a plurality of nozzle lengths to compensate for differences in discharge timing, and a flow resistance of said filters is larger at the nozzles of smaller length than at the nozzles of larger length.

9. An ink jet recording head, comprising:

at least one row of nozzles comprising plural sets of a discharge port for discharging ink, a nozzle communicating with said discharge port and energy generating means for generating energy for discharging ink from said discharge port;

a common liquid compartment connected to said plurality of nozzles; and an ink supplying member for supplying ink from an ink tank, wherein said ink jet recording head comprises plural kinds of filters comprising pillars provided in the vicinity of the entrance of the nozzles in the rows of nozzles, wherein the number of said pillars provided for each nozzle is two or more, and wherein said plural kinds of filters have different opening widths.

10. An ink jet recording head, comprising:

at least one row of nozzles comprising plural sets of a discharge port for discharging ink, a nozzle communicating with said discharge port and energy generating means for generating energy for discharging ink from said discharge port;

a common liquid compartment connected to said plurality of nozzles; and an ink supplying member for supplying ink from an ink tank, wherein said ink jet recording head comprises plural kinds of filters comprising pillars provided in the vicinity of the entrance of the nozzles in the rows of nozzles, wherein the number of said pillars provided for each nozzle is two or more, and wherein said plural kinds of filters have different opening heights.

11. An ink jet recording head, comprising:

at least one row of nozzles comprising plural sets of a discharge port for discharging ink, a nozzle communicating with said discharge port and energy generating means for generating energy for discharging ink from said discharge port;

a common liquid compartment connected to said plurality of nozzles; and an ink supplying member for supplying ink from an ink tank, wherein said ink jet recording head comprises plural kinds of filters comprising pillars provided in the vicinity of the entrance of the nozzles in the rows of nozzles, wherein the number of said pillars provided for each nozzle is two or more, and wherein said plural kinds of filters have different numbers of rows of filters.

* * * * *

UNITED STATES PATENT AND TRADEMARK OFFICE

CERTIFICATE OF CORRECTION

PATENT NO. : 6,502,927 B2
DATED : January 7, 2003
INVENTOR(S) : Minoru Nozawa

It is certified that error appears in the above-identified patent and that said Letters Patent is hereby corrected as shown below:

Title page,
Item [56], U.S. PATENT DOCUMENTS, insert:
-- 5,808,644 9/1998 Imamura et al.
5,847,737 12/1998 Kaufman et al. --; and
after last cited U.S. PATENT DOCUMENT, insert:
-- FOREIGN PATENT DOCUMENTS
JP 5-124206 5/1993
JP 10-86377 4/1998 --.

Signed and Sealed this

Seventh Day of October, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,502,927 B2
DATED : January 7, 2003
INVENTOR(S) : Minoru Nozawa

It is certified that error appears in the above-identified patent and that said Letters Patent is hereby corrected as shown below:

Title page,
Item [56], U.S. PATENT DOCUMENTS,
Insert: -- 5,808,644 9/1998 Imamura et al.
5,847,737 12/1998 Kaufman et al. --; and
After last cited U.S. PATENT DOCUMENTS,
Insert: -- FOREIGN PATENT DOCUMENTS
JP 5-124206 5/1993
JP 10-86377 4/1998 --

Signed and Sealed this

Fourteenth Day of October, 2003

JAMES E. ROGAN
*Director of the United States Patent and Trademark Office*